US010919063B2

(12) United States Patent
Lee

(10) Patent No.: US 10,919,063 B2
(45) Date of Patent: Feb. 16, 2021

(54) SQUEEZE SPRAYER FOR FLUID PRODUCTS

(71) Applicant: Yen Kean Lee, Rohnert Park, CA (US)

(72) Inventor: Yen Kean Lee, Rohnert Park, CA (US)

(73) Assignee: RIEKE PACKAGING SYSTEMS LIMITED

( * ) Notice: Subject to any disclaimer, the term of this patent is extended or adjusted under 35 U.S.C. 154(b) by 0 days.

(21) Appl. No.: 16/336,922

(22) PCT Filed: Sep. 27, 2017

(86) PCT No.: PCT/US2017/053628
§ 371 (c)(1),
(2) Date: Mar. 27, 2019

(87) PCT Pub. No.: WO2018/064118
PCT Pub. Date: Apr. 5, 2018

(65) Prior Publication Data

US 2020/0030832 A1 Jan. 30, 2020

Related U.S. Application Data

(60) Provisional application No. 62/400,114, filed on Sep. 27, 2016.

(51) Int. Cl.
*B05B 11/04* (2006.01)
*B05B 1/34* (2006.01)
(Continued)

(52) U.S. Cl.
CPC ..... *B05B 11/043* (2013.01); *B05B 1/3436* (2013.01); *B05B 7/0433* (2013.01);
(Continued)

(58) Field of Classification Search
CPC ... B05B 1/3436; B05B 7/0441; B05B 7/0433; B05B 11/043; B05B 11/0008;
(Continued)

(56) References Cited

U.S. PATENT DOCUMENTS 3,474,936 A * 10/1969 McDonnell ..... B05B 11/043 222/211
3,510,061 A * 5/1970 Peczeli ..... B05B 7/0892 239/8

(Continued)

OTHER PUBLICATIONS

PLUS Search Results for this application, produced internally by the "STIC" team, produced on Sep. 10, 2020 for Andrew Bainbridge (Year: 2020).*

(Continued)

*Primary Examiner* — Paul R Durand
*Assistant Examiner* — Andrew P Bainbridge
(74) *Attorney, Agent, or Firm* — McDonald Hopkins LLC

(57) ABSTRACT

A squeeze sprayer for dispensing fluid product as a spray or spray mist includes a squeeze bottle and a squeeze sprayer closure attached to the squeeze bottle. The squeeze sprayer includes a cap which defines a chamber for receipt of air and fluid and further defines an outlet. Further included as a part of the squeeze sprayer is a valve which is assembled into the cap and a dip tube which is received by the cap. The dip tube is constructed and arranged to provide air to the chamber and the squeezing of the bottle forces air and fluid into the chamber and from there through the outlet to be dispensed as a spray or spray mist. A second embodiment provides an upright squeeze sprayer with a unique orifice cup. A third embodiment includes a directional adapter.

10 Claims, 14 Drawing Sheets

(51) Int. Cl.
*B05B 7/04* (2006.01)
*B05B 11/00* (2006.01)

(52) U.S. Cl.
CPC ..... *B05B 11/007* (2013.01); *B05B 11/0008* (2013.01); *B05B 11/0032* (2013.01); *B05B 11/0059* (2013.01); *B05B 11/0089* (2013.01)

(58) Field of Classification Search
CPC ..... B05B 11/0032; B05B 11/0059; B05B 11/007; B05B 11/0072; B05B 11/0089; B05B 11/04; B05B 11/041; B05B 11/042
USPC ..... 222/206–215, 630–633, 145.5–145.6, 222/494–496; 239/333
See application file for complete search history.

(56) References Cited

U.S. PATENT DOCUMENTS 3,710,989 A * 1/1973 Armour ..... B65D 47/148 222/562
4,015,753 A * 4/1977 Bennett ..... B05B 11/045 222/633
4,122,979 A * 10/1978 Laauwe ..... B05B 7/0416 222/211
4,186,882 A * 2/1980 Szczepanski ..... B05B 11/0059 222/211
4,415,122 A * 11/1983 Laauwe ..... B05B 11/043 239/327
4,773,570 A * 9/1988 Workum ..... B05B 7/0037 222/190
4,850,729 A * 7/1989 Kramer ..... A46B 11/0041 401/183
5,183,186 A 2/1993 Delaney
6,250,568 B1 * 6/2001 Prueter ..... A61M 11/02 222/211
6,398,133 B1 * 6/2002 Schultz ..... B05B 11/043 222/402.18
6,402,054 B1 * 6/2002 Prueter ..... B05B 11/04 222/211
6,868,990 B2 * 3/2005 Cater ..... B05B 7/0031 222/145.5
8,926,840 B2 1/2015 Hull et al.
9,079,205 B2 7/2015 Hoskins
9,120,108 B2 * 9/2015 Hofte ..... B05B 7/0037
2007/0199959 A1 8/2007 Getsy
2013/0104939 A1 * 5/2013 Shibata ..... B05B 11/047 134/25.1
2014/0061247 A1 * 3/2014 Arminak ..... A47K 5/14 222/190
2016/0158775 A1 * 6/2016 Petkus ..... B05B 11/0037 239/1
2019/0046744 A1 * 2/2019 French ..... A61H 33/0095

OTHER PUBLICATIONS

Patent Cooperation Treaty (PCT), International Search Report and Written Opinion for Application PCT/US2017/053628 filed Sep. 27, 2017, dated Dec. 29, 2017 International Searching Authority, US.

* cited by examiner

SQUEEZE SPRAYER FOR FLUID PRODUCTS

CROSS-REFERENCE TO RELATED APPLICATION

This application is a 35 U.S.C. 371 national stage filing of PCT Application No. PCT/US2017/053628 filed on Sep. 27, 2017, entitled "SQUEEZE SPRAYER FOR FLUID PRODUCTS," which claims the benefit of Provisional Patent Application Ser. No. 62/400,114 entitled "SQUEEZE SPRAYER FOR FLUID PRODUCTS," with a filing date of Sep. 27, 2016, the entirety of which are incorporated herein by reference in their entirety.

FIELD OF THE INVENTION

The present disclosure generally relates to systems, devices, and methods for spraying material with a squeezable container.

BACKGROUND

The broad category of "product dispensers" includes dispensers for particulate matter as well as for flowable material. Within the subset of product dispensers for flowable material one will find lotion dispensers and foam dispensers, as a couple of examples. Another type of fluid dispenser for flowable product would be a sprayer pump or trigger sprayer. The product which is dispensed from this type of structure is often the result of atomization with the selected fluid product being delivered as a mist or spray.

Atomization of a fluid product is commonly achieved by the use of a pump sprayer mechanism with a trigger member (i.e. a "leveler"), thus a trigger sprayer. The pump engine of the trigger sprayer is able to achieve high back pressure and thereby increase the flow velocity to achieve atomization. Often pump sprayer mechanisms, such as trigger sprayers and finger mist sprayers, require as many as 6 to 9 component parts in their construction. The component parts may add to cost, complexity, manufacture time, and potential for malfunction. For these and other reasons, it is desirable to reduce the amount of component parts.

Fluid dispensers of the type generally discussed herein can also be constructed as a squeeze bottle dispenser (e.g., squeeze sprayer). In this category of spray dispenser or spray mist dispenser, it is the manual squeezing of the bottle, rather than the use of a trigger member/mechanism, which creates the requisite pressure for the necessary flow velocity to achieve atomization of the fluid product.

One consideration as a part of the design for squeeze sprayers is whether it will be used as an upright fluid (spray) dispenser or will be used as an inverted fluid (spray) dispenser. In the case of an inverted spray/mist dispenser, there can be a design issue in terms of dripping of the fluid product when the dispenser is inverted and the bottle is not squeezed for an extended period of time. It is thus desirable to have squeeze sprayers that mitigates dripping of fluid product when the squeeze sprayer is inverted and not squeezed for an extended time. It is also desirable to have a construction which enables directional aiming of the spray.

SUMMARY

Disclosed herein is a squeeze sprayer for dispensing fluid product as a spray or spray mist, the squeeze sprayer comprising, a container, a cap coupled with the container, the cap comprising an outlet and a chamber for receipt of air and fluid product, a valve coupled with the cap and comprising a fluid passageway to the chamber; and a dip tube coupled to the cap, the dip tube comprising an inner fluid passageway in fluid communication with the chamber, wherein applying pressure to the container forces a first material through the fluid passageway of the valve and forces a second material through the inner fluid passageway of the dip tube. In an aspect, the cap has a single-piece construction which includes a sleeve extending from a panel. The sleeve defines the chamber and receives the dip tube. The squeeze spray includes a fluid channel defined by a portion of an outer surface of the dip tube and a portion of the inner surface of the sleeve. The chamber is in fluid flow communication with the fluid channel. The cap includes a flip-top lid. The cap and valve are coupled via a friction fit. The valve includes side walls, a panel, and an opening formed through the panel. The panel has a different thickness than the side walls. In one example that first material is a fluid and the second materials is a gas. In another example, the first material is a gas and the second material is air.

A squeeze sprayer for dispensing fluid product is disclosed an comprises a container operatively retaining fluid product and comprising deformable side walls extending from a bottom end; a closure received by the container; a valve comprising an orifice cup received by the closure, the orifice cup defining a mixing chamber and an outlet for dispensing the fluid product; and a dip tube coupled at a first end with the closure, wherein the second end is disposed proximal the bottom end of the container, the dip tube operatively providing either air or a fluid product to the closure. The closure has a single-piece construction and is constructed and arranged with an annular sleeve. The orifice cup has a single-piece construction and is constructed and arranged with an air inlet. The orifice cup comprises a plurality of spokes extending from a body of the orifice cup towards a central axis of the orifice cup.

In another aspect, disclose is a squeeze sprayer for dispensing fluid product, the squeeze sprayer comprising: a squeeze container operatively retaining fluid product and comprising deformable side walls extending from a bottom end; a closure coupled to the squeeze container and comprising a single-piece construction, the closure comprising side walls, a panel extending between the side walls, a mixing chamber, and a sleeve extending from the panel towards the squeeze container; a dip tube with one end received by the sleeve and an opposite end extended into the squeeze container, the dip tube comprising an internal passageway; and a channel defined by a portion of the dip tube and a portion of the sleeve, wherein the channel and the internal passageway are in fluid communication with the mixing chamber, and wherein the channel provides one of air or fluid to the mixing chamber for mixing with one of air or fluid provided to the mixing chamber by the internal passageway. The squeeze sprayer includes an adapter operatively directing a spray or spray mist, the adapter being positioned between the squeeze container and the closure. The adapter has a single-piece construction with a first end coupled to a neck portion of the squeeze container and a second end which is coupled to the closure. The squeeze sprayer includes a two-way valve in fluid communication with at least one of the channel or the internal passageway Further forms, objects, features, aspects, benefits, advantages, and embodiments of the present invention will become apparent from a detailed description and drawings provided herewith.

DETAILED DESCRIPTION

Figure 1:
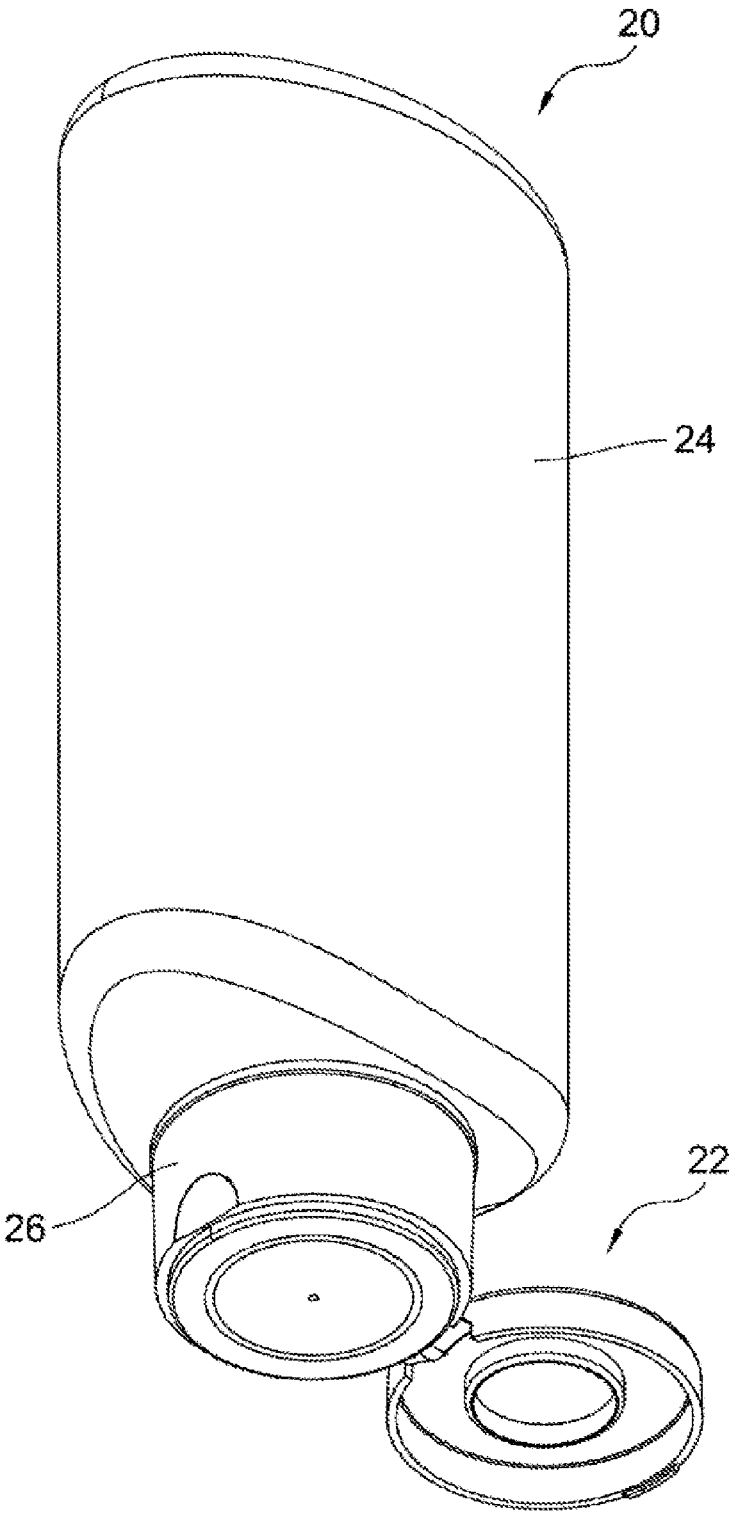
FIG. 1 is a perspective view of a squeeze sprayer in accordance with various disclosed aspects.

Reference will now be made in detail to embodiments of the present teachings, examples of which are illustrated in the accompanying drawings. It is to be understood that other embodiments may be utilized and structural and functional changes may be made without departing from the respective scope of the present teachings. Moreover, features of the various embodiments may be combined or altered without departing from the scope of the present teachings, e.g., features of each embodiment disclosed herein may be combined or replaced with features of the other embodiments disclosed herein. As such, the following description is presented by way of illustration only and should not limit in any way the various alternatives and modifications that may be made to the illustrated embodiments and still be within the spirit and scope of the present teachings.

Within this disclosure various terms are used to explain a particular direction or orientation. It will be assumed throughout this disclosure that the consistent frame of reference is the earth and the direction of the earth's gravitational force. For use herein, this direction is downward and is vertical. A direction which is perpendicular to this vertical gravitational force vector is "horizontal." With respect to a dispenser, such as the squeeze sprayers disclosed herein, an upright orientation positions the axial or longitudinal centerline of the container on the vertical with the dispensing opening being positioned above the base or bottom of the container.

When the dispensing opening is axially below the base or bottom of the container, the squeeze sprayer is described as being inverted. In this context, "above" means in a direction away from the direction of gravitational pull. Also, axial and longitudinal are terms which directionally correspond to vertical, and lateral is a term which directionally corresponds to horizontal.

Some traditional sprayers include spray heads that have multiple parts that are assembled together. These parts may be small components that must be manufactured and then positioned relative other parts. In addition, the different components may allow for fluid to leak. The term "fluid" is used herein to encompass a range of different flowable materials with different viscosities at standard conditions. It is also acknowledged that viscosities may vary with changes in temperature. It is noted that the fluid may be a liquid, gel, particulate suspended in a liquid, or the like.

The term "container" generally refers to a bottle, tube, or other structure capable of holding a fluid product. It is noted that a container may comprise various materials, such as plastics, metals, or the like. Generally, described embodiments utilize containers that are capable of receiving pressure, such as from a user squeezing a body of the container, and capable of deforming. The materials utilize for the containers may have elastomeric properties such that they revert back to generally their original size and shape.

Described herein is a sprayer for fluid products. In an embodiment, the sprayer is a squeeze sprayer that includes a container coupled with a closure. The closure includes a diaphragm valve. The diaphragm valve may be a two way diaphragm that operatively seals a passageway when the container is not squeezed and allows for fluid flow (e.g., liquid, gas, etc.) when the container is squeezed. Disclosed sprayers may utilize less component pieces than some traditional squeezable containers. In another aspect, disclosed embodiments may generally prevent the flow of material or leakage when the sprayer is inverted.

Referring to FIGS. 1-9, there is illustrated a squeeze sprayer 20 which may include the assembled combination of squeeze sprayer closure 22 and squeeze container or container 24. The squeeze sprayer closure 22 (see FIGS. 3A-C, and 4-9) includes a squeeze sprayer cap 26, a diaphragm valve 28 and a dip tube 30. As described herein, these components may comprise the entirety of the squeeze sprayer closure 22. Embodiments may describe various components of the squeeze sprayer 20 as annular in shape or otherwise described with reference a particular shape. It is noted, however, that components may comprise other shapes, such as fame-like polygons, ellipses, or the like. While embodiments may illustrate ring-shaped components, the components may comprise n-sided polygon shapes, where n is a number, elliptical shapes, or irregular shaped components. Moreover, while components may be described as generally concentric, embodiments may comprise non-concentric configurations.

Figure 2:
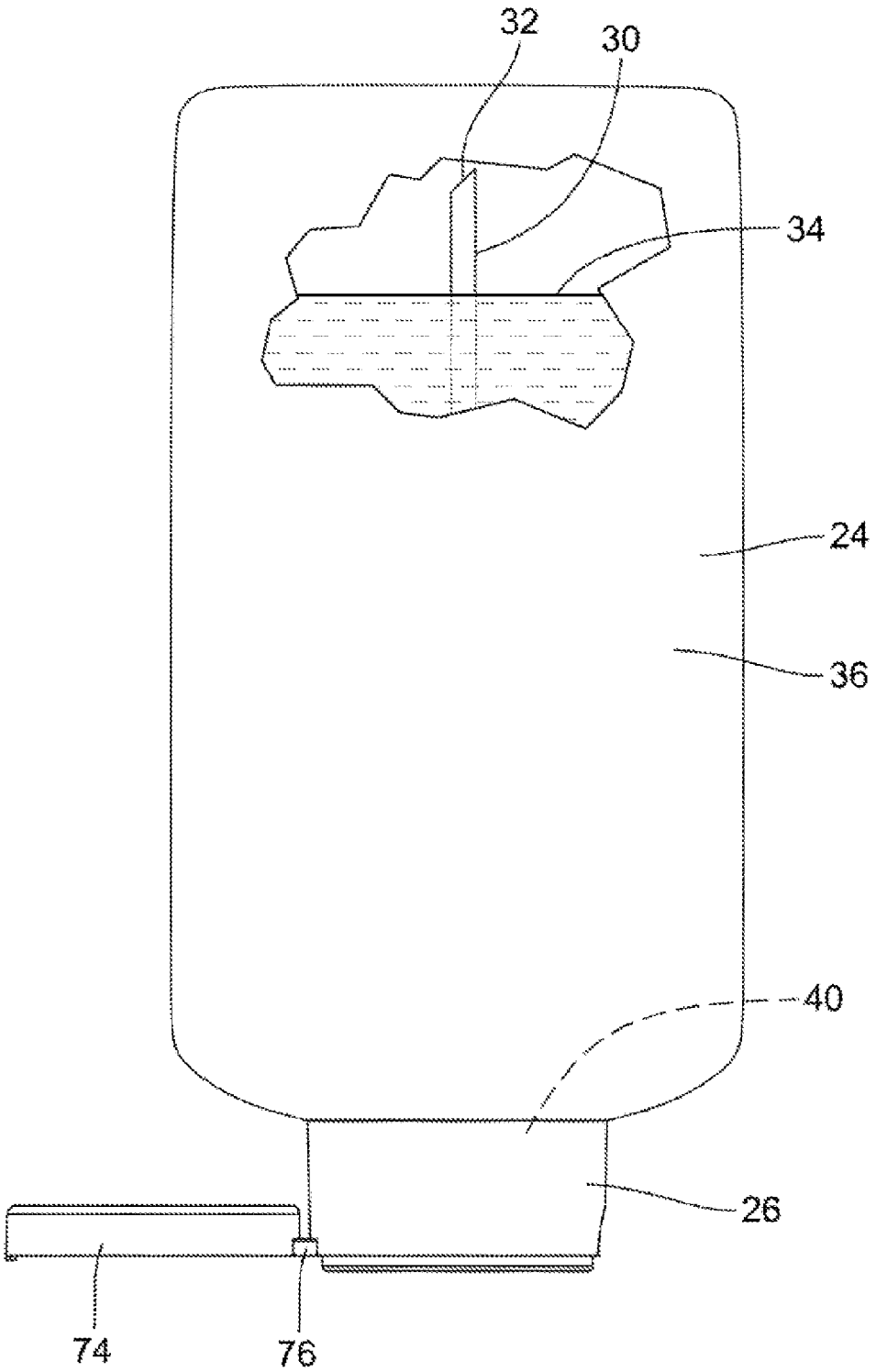
FIG. 2 is a fragmentary, side elevational view of the FIG. 1 squeeze sprayer in accordance with various disclosed aspects.

It is noted that the squeeze sprayer 20 may be an inverted squeeze sprayer where contents is squeezed from the squeeze sprayer 20 when the cap 26 faces generally downwards such that the cap 26 is below the container 24. In an example, as shown in FIG. 2, the cap 26 faces downwards such that an inlet 32 of the dip tube 30 is positioned above the fluid level 34 such that air is drawn into the dip tube 30 from a headspace of air in the container 24 in response to pressure (e.g., squeezing inwardly) on side wall 36 of container 24. It is noted that the inlet 32 may comprise an angled end of the dip tube 30. In some embodiments, the end may be flat.

Figure 3A:
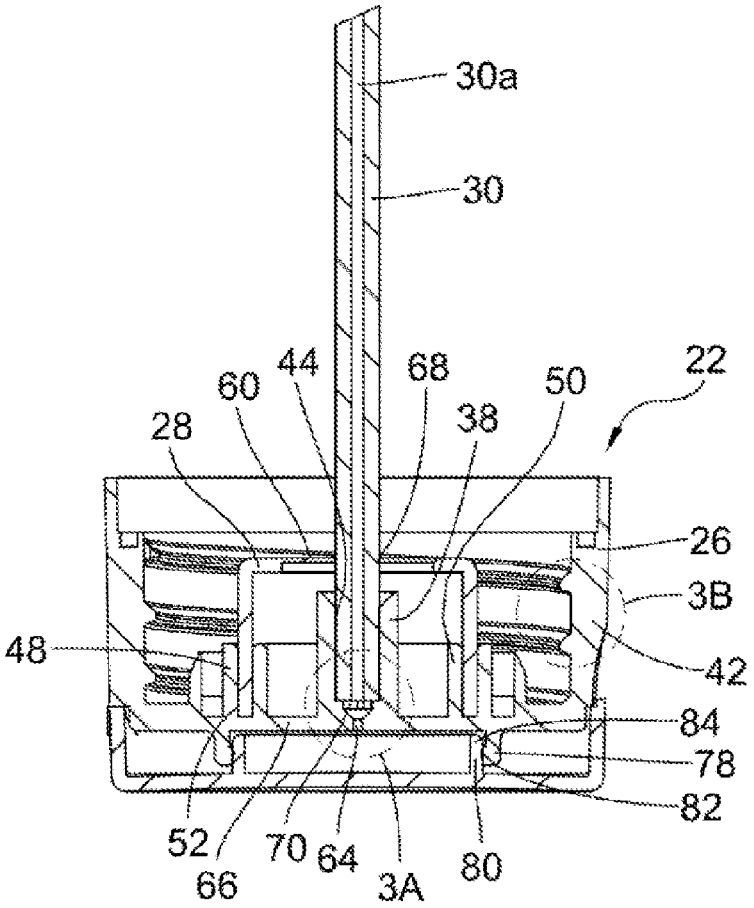
FIG. 3A is a front elevational view, in full section, of a squeeze sprayer closure, in a closed condition, which comprises one part of the FIG. 1 squeeze sprayer. In accordance with various disclosed aspects.
Figure 3B:
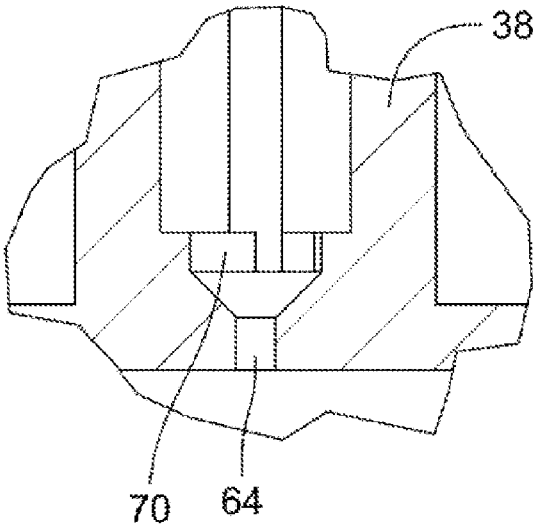
FIG. 3B is an enlarged detail of a chamber of the FIG. 3 squeeze sprayer closure which chamber leads to a dispensing outlet in accordance with various disclosed aspects.
Figure 3C:
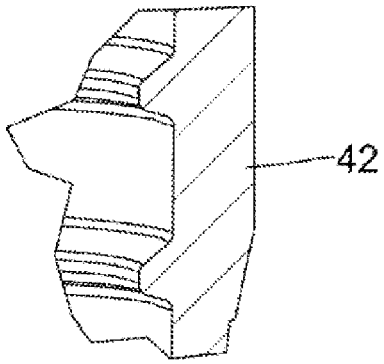
FIG. 3C is an enlarged detail of a threaded wall of the FIG. 3 squeeze sprayer closure in accordance with various disclosed aspects.
Figure 4:
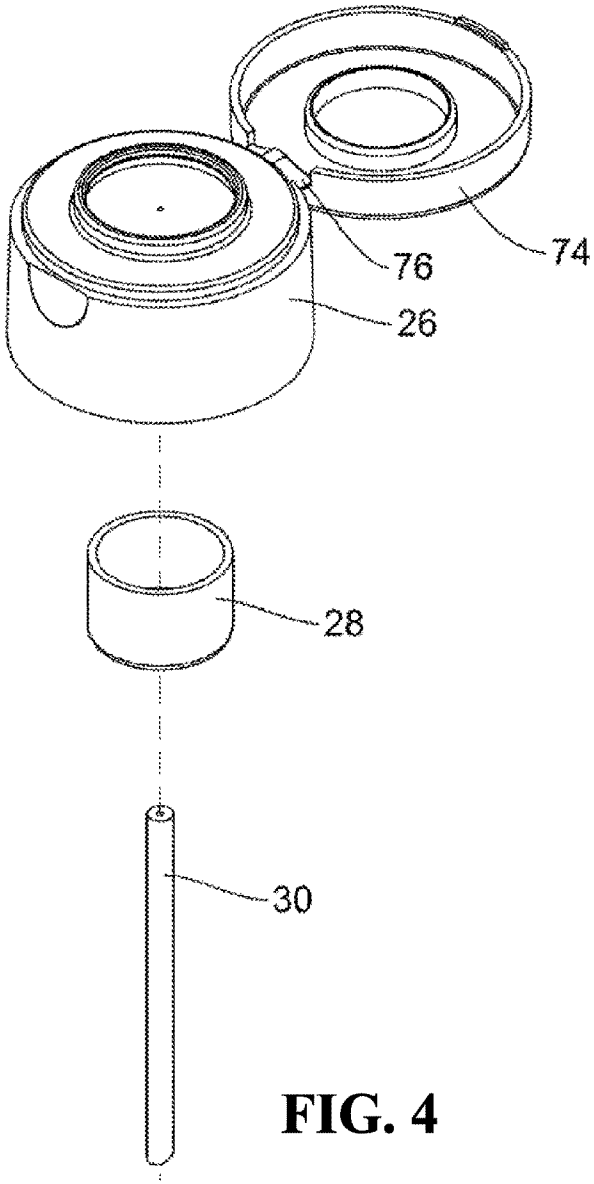
FIG. 4 is an exploded view of the FIG. 3 squeeze sprayer closure, turned to an upright orientation in accordance with various disclosed aspects.

With reference to FIGS. 3A and 4, the sprayer closure 22 may be assembled through the connection or assembly of the squeeze sprayer cap 26, the diaphragm valve 28 and the dip tube 30. As described in more detail herein, the diaphragm valve 28 may be attached to the sprayer cap 26 through a mechanical connection (e.g., friction fit channel, bayonet-type, fasteners, threaded members, over molded seal, or the like), chemical connection (e.g., adhesive), magnetic connection or the like. Likewise, the dip tube 30 may be attached to at least one of the squeeze sprayer cap 26 or the diaphragm valve 28 via mechanical, chemical, or magnetic connections.

In at least one embodiment the container 24 may comprise a neck 40 (which may be annular). The sprayer cap 26 may be attached to the neck 40, such as via mechanical, chemical, or magnetic connections. For instance, the neck 40 of container 24 and the sprayer cap 26 may be threadedly engagable with each other. In an embodiment, the neck 40 may be externally threaded while an inner surface of the annular outer wall 42 of sprayer cap 26 is internally threaded in a corresponding and cooperative manner, see FIGS. 3A and 3B. This cooperative threaded construction allows the sprayer cap 26 to be threaded onto the bottle neck 40 for the secure assembly of the sprayer cap 26 and container 24. It is further noted that the neck 40 and the sprayer cap 26 may be locked into place via a tab or other device. For example, a tamper-resistant tab or child-proof lock may secure the sprayer cap 26 and container 24

As shown in FIGS. 3A and 4-9, the cap 26 may include a sleeve 38 that is sized and shaped to receive the dip tube 30. The dip tube 30 may comprise straw-like configurations that may be substantially cylindrical. The sleeve 38 may receive and secure the dip tube 30, such as through a friction fit connection. In an example, a moderate level of interference fit is selected as the way to retain the dip tube 30 in this assembled condition within sleeve 38. This interference fit is not required for the full axial length of sleeve 38, only enough area of interference fit to retain the dip tube 30 in this retained position. It is noted, that the dip tube 30 may be secured with the cap 26 via other methods, such as an adhesives, or the like.

Figure 8:
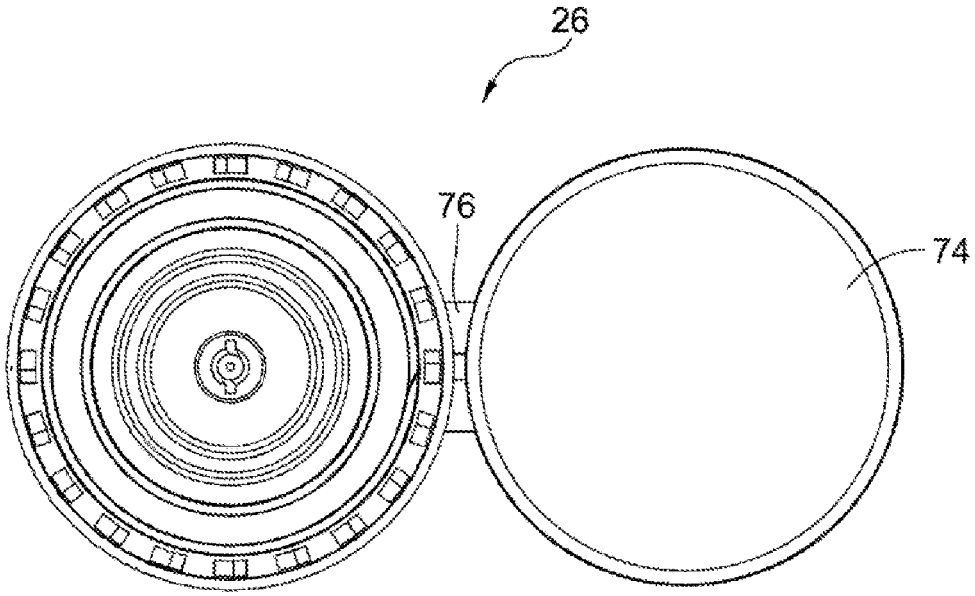
FIG. 8 is a bottom plan view of the FIG. 5 squeeze sprayer closure in an open condition in accordance with various disclosed aspects.
Figure 9:
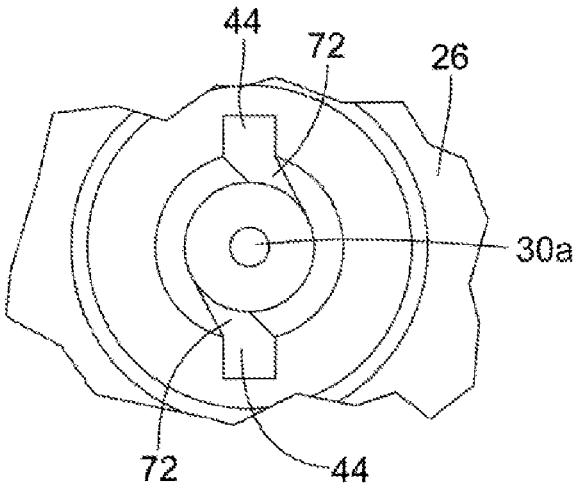
FIG. 9 is an enlarged detail of the chamber which is part of the flip-top cap in accordance with various disclosed aspects.
Figure 10:
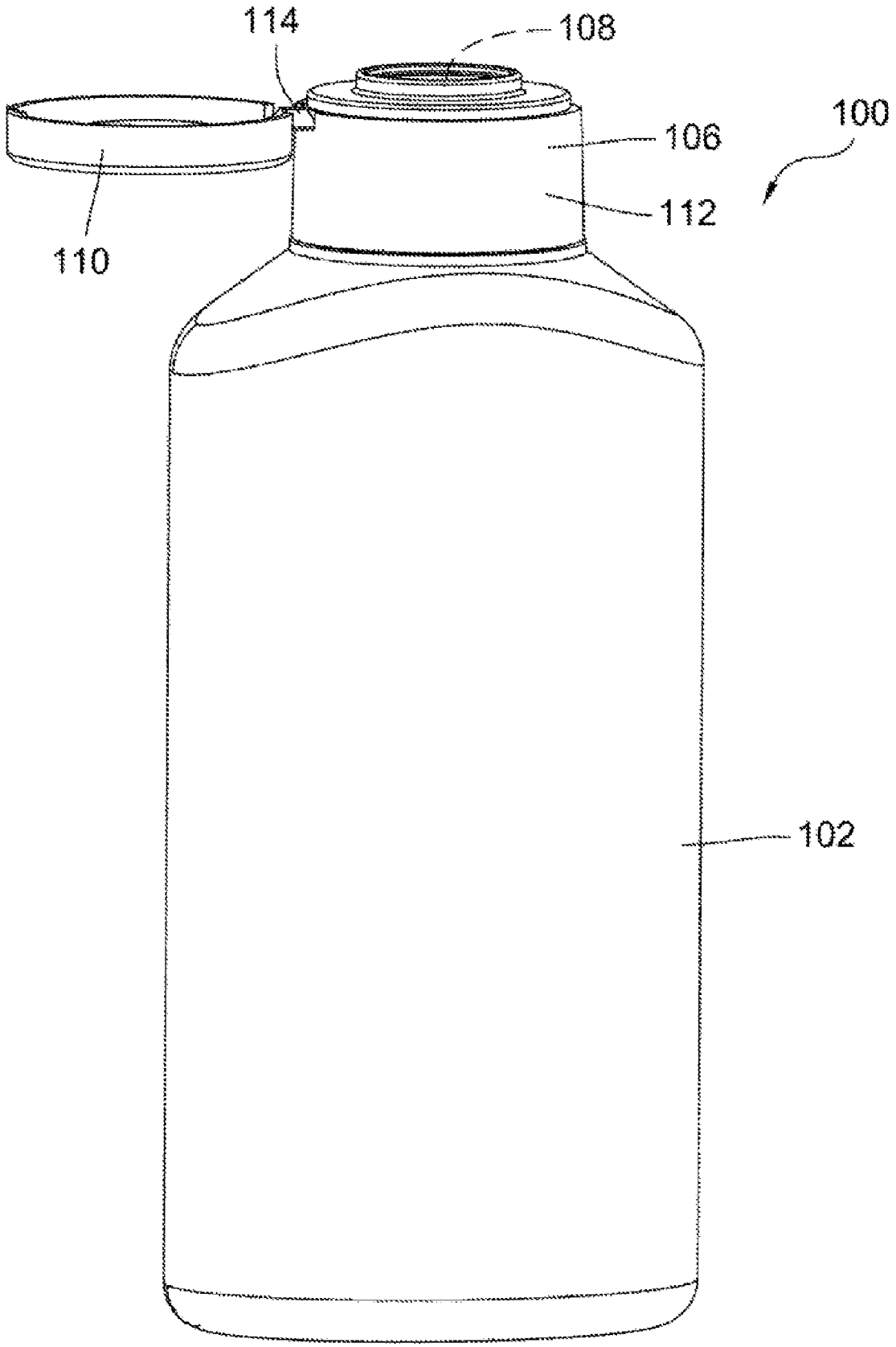
FIG. 10 is a perspective view of an upright squeeze sprayer according to a second exemplary embodiment of the present invention, with its closing lid in an open position in accordance with various disclosed aspects.

According to an aspect, the cap 26 includes a fluid passageway or fluid channel 44 between the sleeve 38 and the dip tube 30. In an exemplary embodiment the fluid channel 44 may be formed in the body of sleeve 38 as shown in FIGS. 8-9. The fluid channel 44 may be generally uniform in depth along the length of the fluid channel. For example, the fluid channel 44 may comprise a rectangular cutout in the sleeve 38. It is noted however, that the embodiments may include fluid channels 44 that may be tapered, spiraled, or the like. The size and configuration of the fluid channel 44 may adjust the flow rate, velocity, or other parameter of fluid passing through the fluid channel 44.

It is noted that the sleeve 38 may include i fluid channels 44, where i is a number. For instance, the sleeve 38 may include two, four, or another number of fluid channels 44. Moreover, it is noted that the fluid channels 44 may be disposed or formed via other components of the sprayer closure 22. In an example, the dip tube 30 may comprise all or part of the fluid channel 44. In another example, the dip tube 30 may comprise a first fluid channel and the sleeve 38 may comprise a second fluid channel.

Cap 26 includes a panel 66 that may separate the internal cavity of the container 24 from an external environment and/or a lid 74. The panel 66 may be uniform in thickness or may comprise varied thicknesses as it extends across inner portion 50. An annular channel 52 extends from the panel 66 in an opposite direction as the lid 74. For instance, cap 25 may comprise an inner wall 46 which may be generally concentric with sleeve 38, which similarly extends from the panel 66 in generally the same direction as inner wall 46. Inner wall 46 may include an outer portion 48 and a radially inner portion 50 which together define therebetween the channel 52. The diaphragm valve 28, or a portion thereof, may be disposed within the channel 52 such that friction may hold or secure the diaphragm valve 28 with the cap 26, as described herein.

Figure 6:
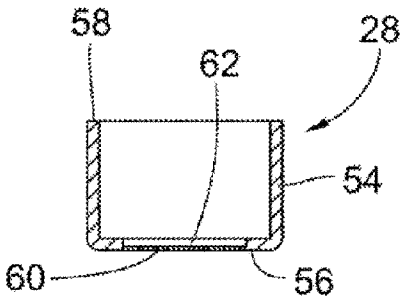
FIG. 6 is a front elevational view, in full section, of a valve which comprises one part of the FIG. 3C squeeze sprayer closure in accordance with various disclosed aspects.

Turning to FIG. 6, with reference to the other figures, the diaphragm valve 28 comprises a two-way diaphragm that allows for flow of fluid in two-ways. According to an embodiment, the diaphragm valve 28 comprises a generally cylindrical shape formed by an annular wall 54, and annular, partially closed end 56 and an annular open end 58. A portion of the wall 54 proximal the open end 58 may be inserted into the channel 52 with a moderate interference of friction fit. This moderate interference fit is sufficient for the channel 52 to retain the diaphragm valve 28 in this assembled condition.

The partially closed end 56 includes a centered panel 60 with a pilot hole 62 for receipt of the dip tube 30. In an aspect, the pilot hole 62 may comprise an inner diameter or lip 68 that is generally a smaller dimension than the outer surface of the dip tube 30. For example the lip 68 may comprise a circumference that is generally smaller than the outer circumference of the dip tube 30. This may allow the pilot hole 62 to form a seal with the dip tube 30 when pressure is not applied to the container 24, as described here as well as elsewhere in this disclosure.

According to at least one embodiment, panel 60 has a thickness which is less than the thickness of the remainder of closed end 56, thereby adding greater flexibility to panel 60 with respect the flexibility of the remainder of the closed end 56. Providing an increased wall thickness for wall 54 as compared to panel 60 enables end 58 to have sufficient rigidity to be inserted into channel 52 with the moderate interference fit as described herein. The panel 60 though is more flexible allowing it to flex and deflect (e.g., open) in response to the increased pressure due to squeezing of the container 24 in order to permit the flow of fluid between the lip 68 of the pilot hole 62 and the dip tube 30. It is noted that the valve 28 is preferably a single-piece component fabricated out of an elastomeric material. Moreover, some embodiments may include a valve 28 made from a plurality of pieces (e.g., one for the more rigid wall 54 and another for the flexible panel 60, this, however, could increase the number of component parts, manufacturing steps, cost, or the like. Further, at least one embodiment may include a valve 28 comprising a uniform thickness. For instance, the inner wall 46 may extend a greater distance from panel 66. This increases the depth of the channel 52 and may allow for valve 28 to be secured with the cap 26 while providing flexibility of the panel 60.

When the dip tube 30 is pushed through the pilot hole 60 in order to insert the dip tube 30 into sleeve 38, the portion of panel 60 which immediately surrounds the pilot hole 62 flexes and deflects either in the direction of sleeve 38 or in the opposite direction. This annular portion of panel 60 lays up snugly against the outer surface of the dip tube 30. When there is an interior pressure increased due to the manual squeezing a container 24, air from the headspace of the inverted bottle is forced into inlet 32 and travels to dispensing outlet 64 which is defined by panel 66 of cap 26. Concurrently, fluid from within container 24 is forced against panel 60. The deflected lip 68 resulting from the surrounding annular portion of panel 60 opens slightly creating a clearance flow passage between lip 68 and the outer surface of the dip tube 30. This flow of fluid ultimately reaches the flow channels 44 and flows into chamber 70 which is positioned between the interior of sleeve 38 and dispensing outlet 64. As soon as the pressure is released, such that the fluid flow ends, the lip 68 returns to its sealed condition against the dip tube 30. This rapid closure prevents or generally reduce any suck back of fluid or air and prevents or generally reduce dripping through a dispensing outlet 65 formed through the panel 66. Dispensing outlet 64 is described as being generally defined by panel 66 and chamber 70 is defined by sleeve 38. The hollow interior 30*a* of dip tube 30 opens directly into chamber 70 and chamber 70 opens directly into dispensing outlet 64.

In embodiments, cap 26 comprises single-piece component. Cap 26 may comprise a molded plastic, 3-D printed plastic or other material. As such, there is no specific line which denotes the boundary line between the sleeve 38 and panel 66. In at least some embodiments, the cap 26 and the valve 28 may comprise a single-piece component that is a 3-D printed plastic.

Chamber 70 is in fluid flow communication with the flow channels 44. Similarly, hollow interior 30*a* of the dip tube 30 is in fluid communication with the flow channels 44. This may allow both air and fluid to flow together in the chamber 70 before this combination exits under pressure through outlet 64 as a spray mist. As best shown in FIGS. 3A and 9, the fluid flow channels 44 open into chamber 70, there is a flow corridor extension 72 extending at an angle or curved path from each channel 44. Each flow corridor extension 72 creates a part-circular fluid flow rotation around the end opening of the dip tube 30. The combination of the fluid flow rotation and the airflow at high velocity all within chamber 70 results in the dispensing of a spray mist from dispensing outlet 64, something which occurs promptly upon the manual squeezing of container 24.

Figure 5:
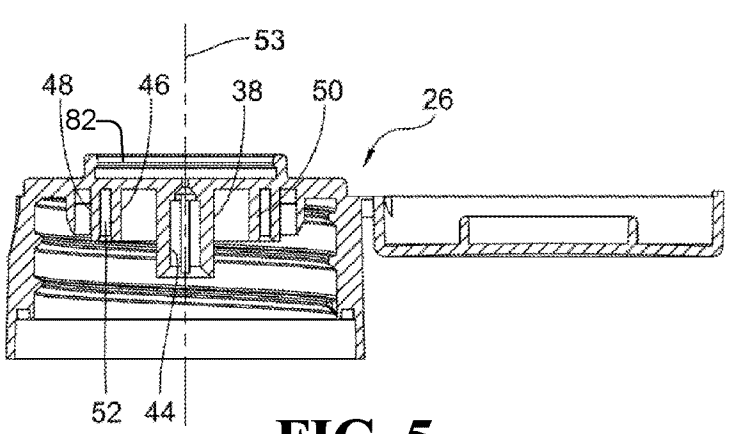
FIG. 5 is a right side elevational view, in full section, of the FIG. 3C squeeze sprayer closure, in an open condition in accordance with various disclosed aspects.
Figure 7:
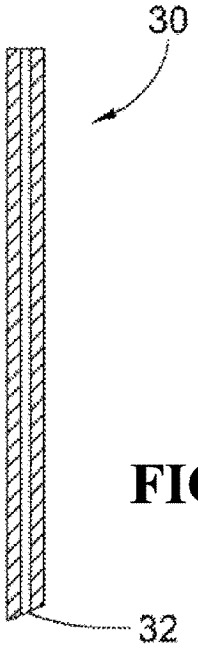
FIG. 7 is a front elevational view, in full section, of a dip tube which comprises one part of the FIG. 3C squeeze sprayer closure in accordance with various disclosed aspects.

Turning to FIGS. 4, 5, and 8, a disclosed embodiment may include a flip-top cap 26. For instance cap 26 includes as part of its single-piece construction a hinged lid 74 which is constructed and arranged to close over panel 66 and close off outlet 64. A living hinge 76 is used to connect lid 74 to the remainder of cap 26. The securement of lid 74 on to the remainder of cap 26 and its close condition is by a snap-fit interfit. Panel 66 includes an annular wall extension 78 and lid 74 includes a cooperating annular wall 80. The wall extension 78 includes a small annular bead 82 on its inner surface. The wall 80 includes a cooperating annular bead 84 on its outer surface for the snap-fit closing of lid 74, as illustrated in FIG. 3A, and is based on the snap over between cooperating annular beads 82 and 84.

It is noted that the cap 26 may comprise other configurations in various embodiments. For example, the cap 26 may comprise a nozzle that extends from the panel 66 in a direction generally opposite the container 24. The nozzle may comprise, for instance, frustoconical protrusion having an internal fluid passageway. A cap or plug may be attached to the nozzle. In another example, the squeeze sprayer 20 may comprise a removable seal (e.g., foil seal, etc.) that extends over the cap 26. The seal may be removable. This may allow the squeeze sprayer 20 to be a single use squeeze sprayer or a tamper resistant sprayer.

As described here and elsewhere in the specification, cap 26 may comprise a substantially cylindrical form, at least in part with its primary structural portions each being substantially cylindrical, as well as substantially concentric such that the axial centerline of the cap 26 is the axial centerline 53 of the sleeve 38 and of the inner wall 46. In other embodiments, the cap 26 and other components may comprise ellipses, polygons, irregular shapes, or other appropriate shapes.

It is noted that disclosed embodiments may allow for squeeze sprayers to be used at an inversion angle. Use in an inversion angle might be something which would be beneficial as a part of alternatively shaping the bottle into a different geometry. If the bottle is more ergonomic at an angle, for example, then use of the disclosed squeeze sprayer at an inversion angle is possible.

Moreover, it is noted that the squeeze sprayer 20 may be squeeze to dispense material in an upright orientation, but is preferable used in an inverted orientation. The squeeze sprayer 20, further, may be stored in any orientation and the squeeze sprayer closure 22 generally prevents leakage via the diaphragm valve 28 and other operative components as described herein.

Accordingly, a second exemplary embodiment of the present invention is specifically constructed and arranged for use in an upright condition with a unique orifice cup that may serve as a diaphragm valve. From a technical perspective, an upright usage reverses the airflow path and the fluid flow path. While these two constituents still come together in a chamber, such as chamber 70, it is the high velocity of air flow which helps to create the desired spray mist in the first exemplary embodiment. When the two flows are reversed, instead of having air at a high velocity one would have fluid at a high velocity. When fluid is delivered by way of the dip tube and the flows of air are rotated in chamber 70, the nature of the spray mist in this adaptation of the first exemplary embodiment will be different, yet likely acceptable for specific uses. One would preferably select the construction of the second exemplary embodiment with its unique orifice cup for an upright squeeze sprayer. A third exemplary embodiment introduces the use of a directional adapter.

Turning now to FIGS. 10-20, there is an exemplary embodiment of an upright squeeze sprayer 100 in accordance with various disclosed aspects. It is noted that like named components of the upright squeeze sprayer 100 may comprise similar aspects as those of squeeze sprayer 20 unless context suggests otherwise or a particular distinction is made. The upright squeeze sprayer 100 primarily comprises container 102, dip tube 104, closure 106 and orifice cup 108. The orifice cup 108 may comprise a separate construction as the closure 106 and may be inserted into or otherwise connected with the closure 106.

Closure 106 may comprise a hinged lid 110 which may be unitarily joined to the closure body 112 by a living hinge 114. A snap-closed construction may be used between lid 110 and closure body 112 in order to have a positive indication of the lid 110 being snapped closed. It is noted that the closure 106 and lid 110 may comprise other constructions as described with reference to the closure 22 of FIGS. 1-9.

Figure 11:
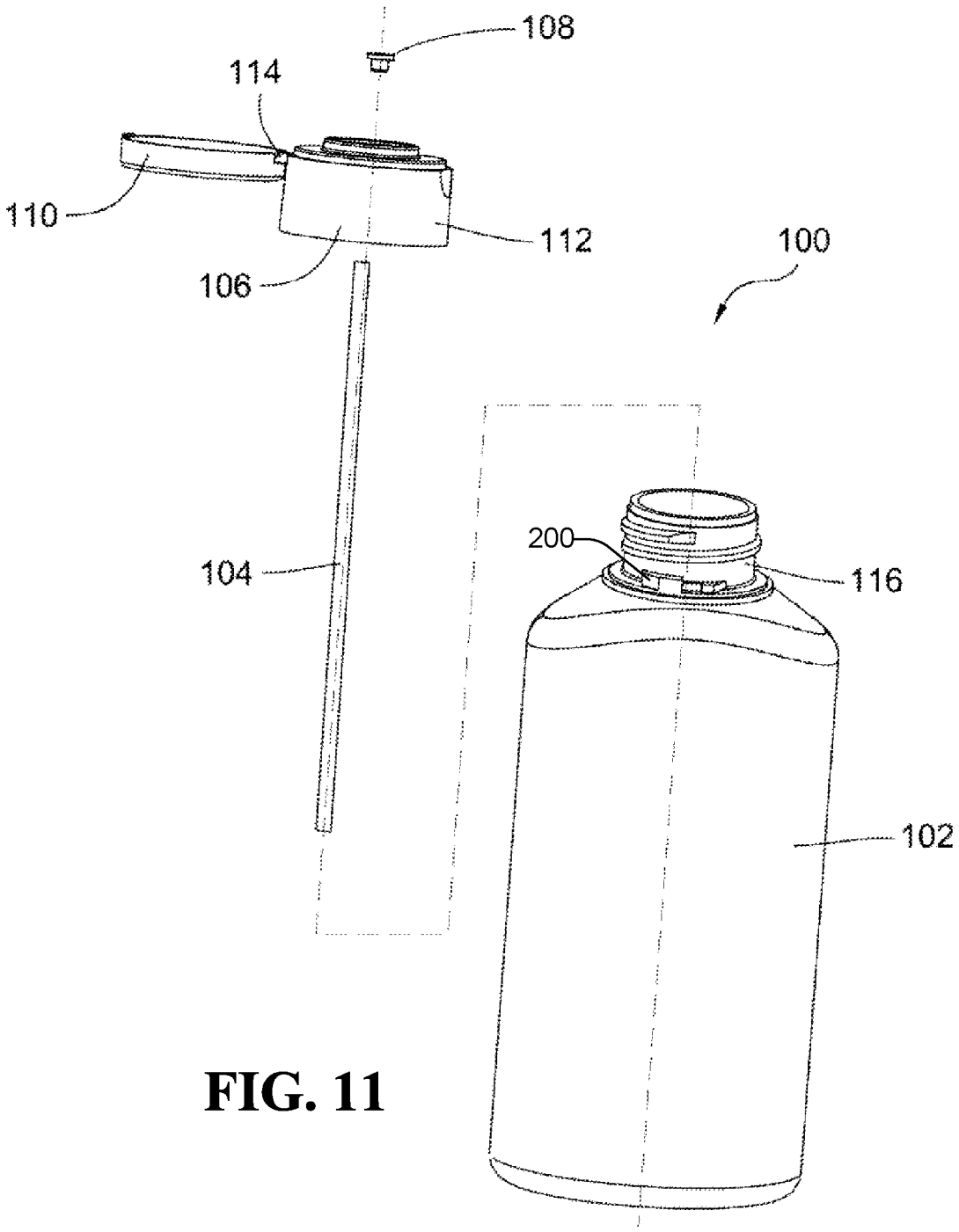
FIG. 11 is an exploded view of the FIG. 10 upright squeeze sprayer in accordance with various disclosed aspects.
Figure 12:
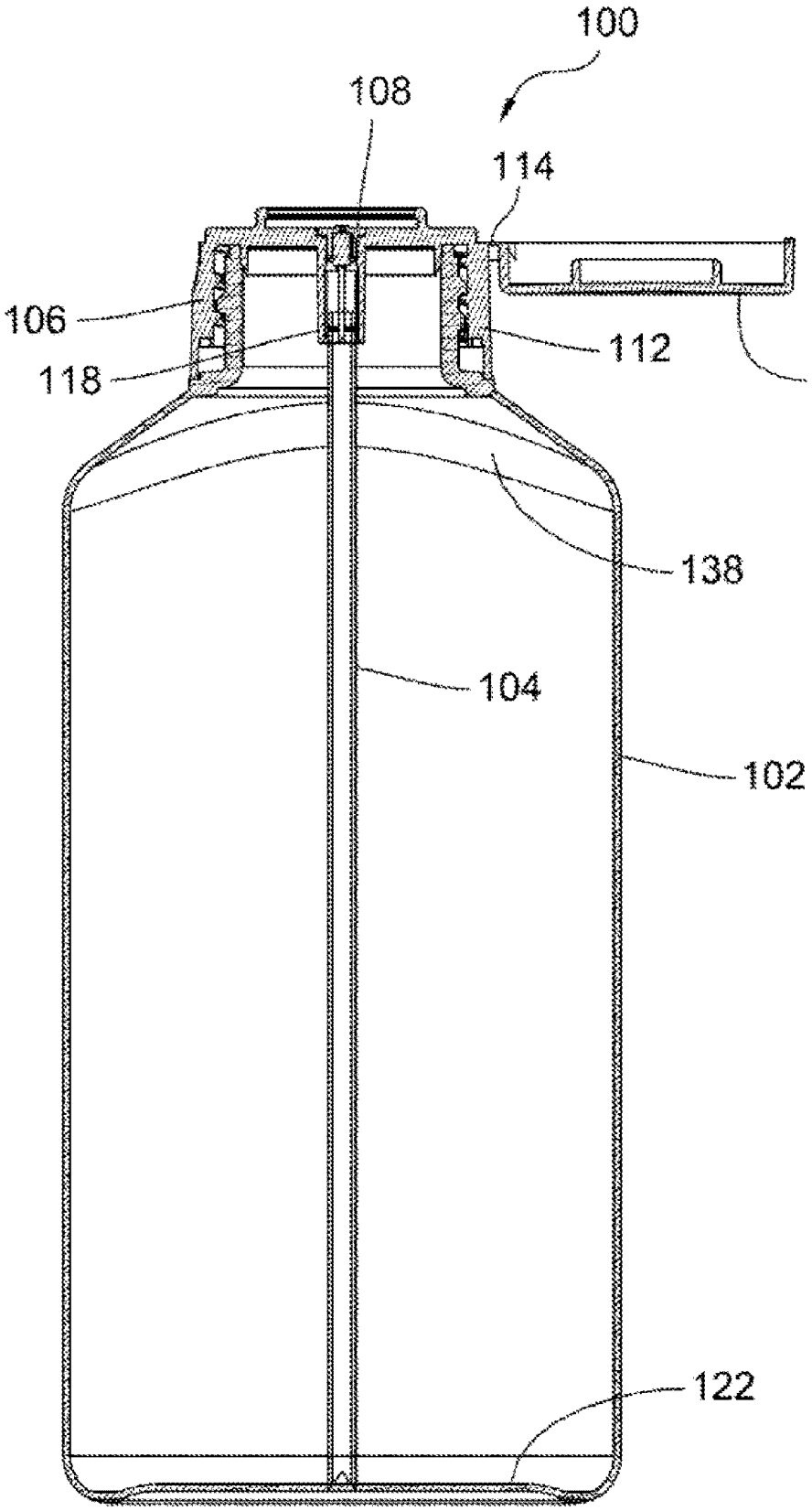
FIG. 12 is a front elevational view, in full section, of the FIG. 10 upright squeeze sprayer in accordance with various disclosed aspects.

As best shown in FIGS. 11-12, the closure 106 may be threadedly engaged with the neck 116 of container 102. In at least some embodiments, the closure 106 may be engaged with the neck 116 in other manners as noted herein. Moreover, the neck 116 may include a locking mechanism 200 that locks the closure 106 into place. The locking mechanism 200 may permanently lock the neck 116 or may be unlocked, such as a child safety-type lock. Moreover, the dip tube 104 may be engaged with the closure 106 such that it is disposed within the bottle 102. In another aspect, the orifice cup 108 may be disposed within or on the body 112 of the closure 106.

The dip tube 104 is a hollow, generally cylindrical tube, preferably fabricated out of plastic. The inside diameter size is selected based on the fluid product (received within container 102) to be dispensed. The outside diameter of dip tube 104 is selected based on the desired wall thickness once the inside diameter is selected. Selection of a suitable inside diameter may be a function of fluid product viscosity and desired spray parameters. The dip tube 104 has a longitudinal or axial dimension which is sufficient to extend to a location which is close to a bottom panel 122 of the container 102. The end of the dip tube 104 proximal the bottom panel 122 may be flush, angled, notched, or otherwise formed. This may allow the dip tube 104 to reach the panel 122 and receive material even when the contents within the bottle 102 is at a low level.

Figure 14:
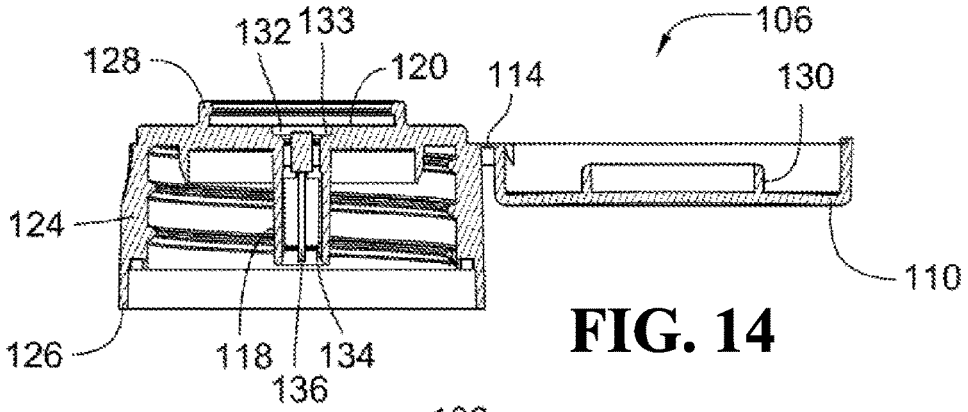
FIG. 14 is a front elevational view, in full section, of the FIG. 18 closure.

The dip tube 104 may be inserted into a sleeve 118 of the closure body 112 as shown in FIG. 12 with reference to FIG. 14. The outside diameter of dip tube 104, at least for the end which is inserted into sleeve 118, is sized and arranged for a tight and secure friction fit into the inside diameter of sleeve 118. In some embodiments, the dip tube 104 may be sized and shaped such that the inner diameter of the dip tube 104 may receive the outer diameter of the sleeve 118 in a friction fit engagement.

Closure body 112 may comprise an upper panel 120 and a lower edge, an outer wall 124 may extend from the lower edge 126 to the upper panel 120. A raised annular lip 128 may extend upwards from the upper panel 120 and may snap-fit with an annular wall 130 of the lid 110. In an exemplary embodiment, the outside diameter of wall 130 is generally 0.30 mm larger than the inside diameter of lip 128, thereby providing a slight interference fit for secure closure of lid 110 on to the closure body 112. It is noted that some embodiments may include the lip 128 having a larger diameter than the diameter of the wall 130.

Figure 15:
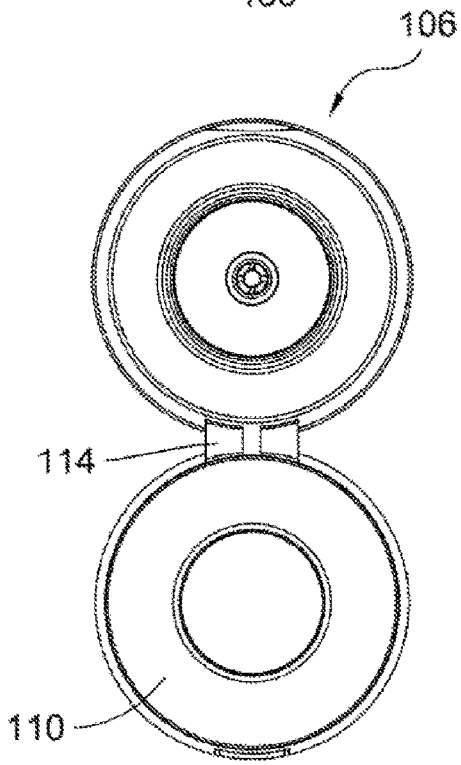
FIG. 15 is a top plan view of the FIG. 18 closure in accordance with various disclosed aspects.
Figure 16:
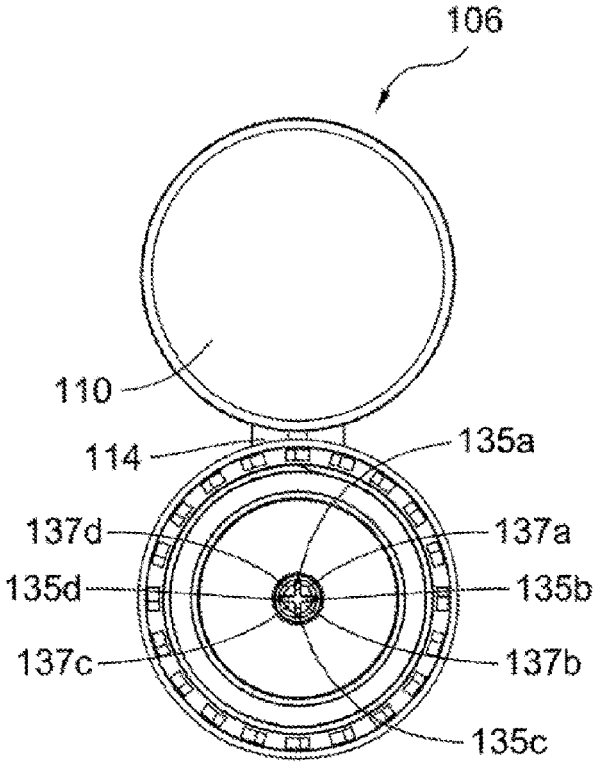
FIG. 16 is a bottom plan view of the FIG. 18 closure.
Figure 17:
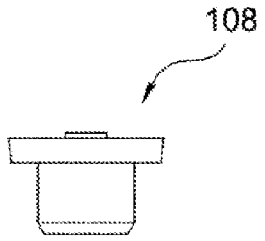
FIG. 17 is a front elevational view of an orifice cup comprising one part of the FIG. 10 upright squeeze sprayer in accordance with various disclosed aspects.
Figure 18:
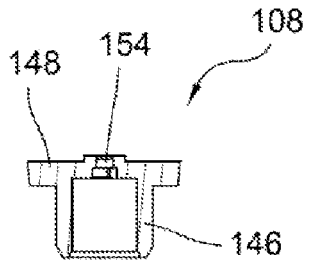
FIG. 18 is a front elevational view, in full section, of the FIG. 17 orifice cup.
Figure 19:
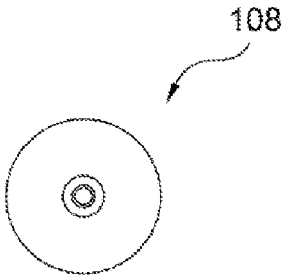
FIG. 19 is a top plan view of the FIG. 17 orifice cup in accordance with various disclosed aspects.
Figure 20:
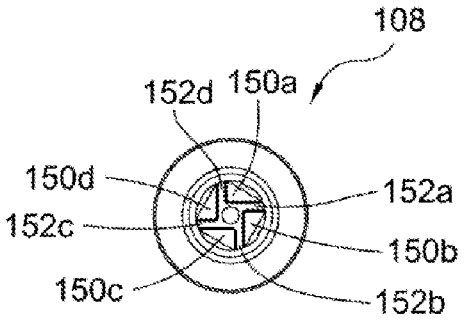
FIG. 20 is a bottom plan view of the FIG. 17 orifice cup in accordance with various disclosed aspects.

In another aspect, the upper panel 120 may include a recess 132 that may receive the orifice cup 108 as shown in FIGS. 14-16. It is noted that the recess 132 and orifice cup 108 may be generally concentric with the annular lip 128. In some embodiments, however, the recess 132 and orifice cup 108 may be generally off-center with respect to the lip 128.

The sleeve 118 extends from the upper panel 120 towards the end 126. An inner surface 134 of the sleeve 118 may comprise one or more air flow channels 136. It is noted that the air flow channels 136 may be formed via molding, 3-D printing, etching, or the like. The number and spacing of the air flow channels 136 as well is the shape, channel depth (radial dimension) and circumferential width are selected, at least in part, based on the products selected to be dispensed and desired spray characteristics or patterns. The spray pattern may include an amount of fluid (e.g., dose amount), ration of air to fluid, velocity, droplet size range, or the like. Selection of the number, positions, and size of the air flow channels 136 may be made to achieve the desired spray pattern for a given product.

Figure 13:
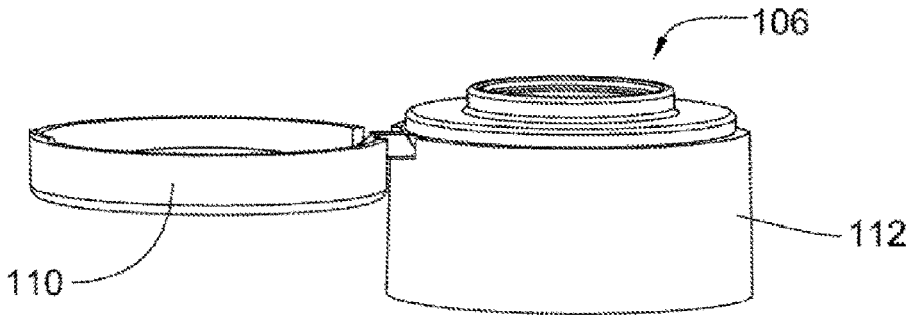
FIG. 13 is a perspective view of a closure which comprises one part of the FIG. 15 upright squeeze sprayer in accordance with various disclosed aspects.

With reference to FIGS. 13 and 16, the closure body 112 may include an outlet panel 133 positioned between the inner surface 134 of sleeve 118 and orifice recess 132. This outlet panel 133 may include one or more (e.g., 2, 3, 4, etc.) radial spokes **135*a*-135*d* and one or more (e.g., 2, 3, 4, etc.) open sections 137*a*-137*d*. In an exemplary embodiment the radial spokes 135*a*-135*d*** may be equally spaced or may be spaced at varying distances from each other.

In an exemplary embodiment, a user may manually squeeze or otherwise apply pressure to the container 102. This may increase the pressure within the container 102 to force material and air to be expelled or sprayed from the closure 106. With reference to FIG. 12, the container 102 may be filed with a fluid product up to a predetermined level such that a head space 138 of air is left within the container 102. In use, when the sides of the container 102 are squeezed inwardly, the volume within the container 102 is reduced. This contraction causes both air and fluid product to flow in their respective directions of least resistance. The squeezing force applied inwardly to the body of the container 102 causes the fluid product in container 102 to both push upwardly on the air in the headspace 138 and travel upwardly through dip tube 104, toward sleeve 118 and into orifice cup 108.

The fluid pressure on the volume of air in headspace 138 forces the air to flow through air flow channels 136 and into the sleeve 118. As described herein, the flow of both air and fluid product at a desired velocity mixes the air and fluid prior to the combination being dispensed as a spray (spray mist) with a desired pattern. In contrast to the embodiments described with reference to inverted squeeze sprayer 20, the fluid flows through the dip tube 104, while the air flows through the flow channels 136 as described in more detail below. The result, however, is similar to the inverted squeeze sprayer 20 in that the volumes of air and fluid product are mixed prior to being forced out through the spray orifice 140 of the orifice cup 108. This spray orifice 140 has a size which results in a higher exiting velocity and this in turn facilitates creating a desired spray pattern for the product. Moreover, the size of the spray orifice 140 is generally smaller than the inner diameter of the dip tube 104.

As described above, the squeezing force applied to the container 102 forces the fluid to flow into the orifice cup 108 by way of the dip tube 104 and enters into the orifice cup 108 in a single, generally centralized location. The air flows into the orifice cup 108 by way of channels 136 of the sleeve 118 and one or more locations depending on the number of channels 136, which are generally radially outward relative the dip tube 104. The entry of the air and fluid into the orifice cup 108 mixes the air and fluid according to a desired spray pattern. The squeezing force applied to the container 102 also forces the spray or spray mist of the mixed composition to exit the spray orifice 140.

With further reference to FIGS. 17-20, the structural details of an exemplary orifice cup 108 are illustrated. Orifice cup 108 has a generally cylindrical body 146 and an upper generally cylindrical flange 148. Internally, the hollow interior of the body 146 is open and the hollow interior of flange 148 is segmented into a plurality (e.g., two, three, four, etc.) spaced apart regions 150*a*-150*d* which are defined by spokes 152*a*-152*d*. It is noted that the regions 150*a*-150*d* may be equally spaced, spaced at varying positions, similar in shape and configuration, or may comprise different shapes or configurations. The body 146 and flange 148 may be generally concentric with a common axial centerline, or may be off-center with respect to each other.

The orifice cup 108 defines a mixing chamber 154 where the incoming flow of fluid product and the flow (or flows) of air premix. This premix occurs before the fluid mixtures propelled through spray orifice 140 for the fluid product to be dispensed as a spray or spray mist in a desired spray pattern as described herein. A particular spray pattern is based in part on the shaping of orifice 140 and in part on the exit velocity of the fluid mixture (air and product) as it passes through orifice 140.

Figure 21:
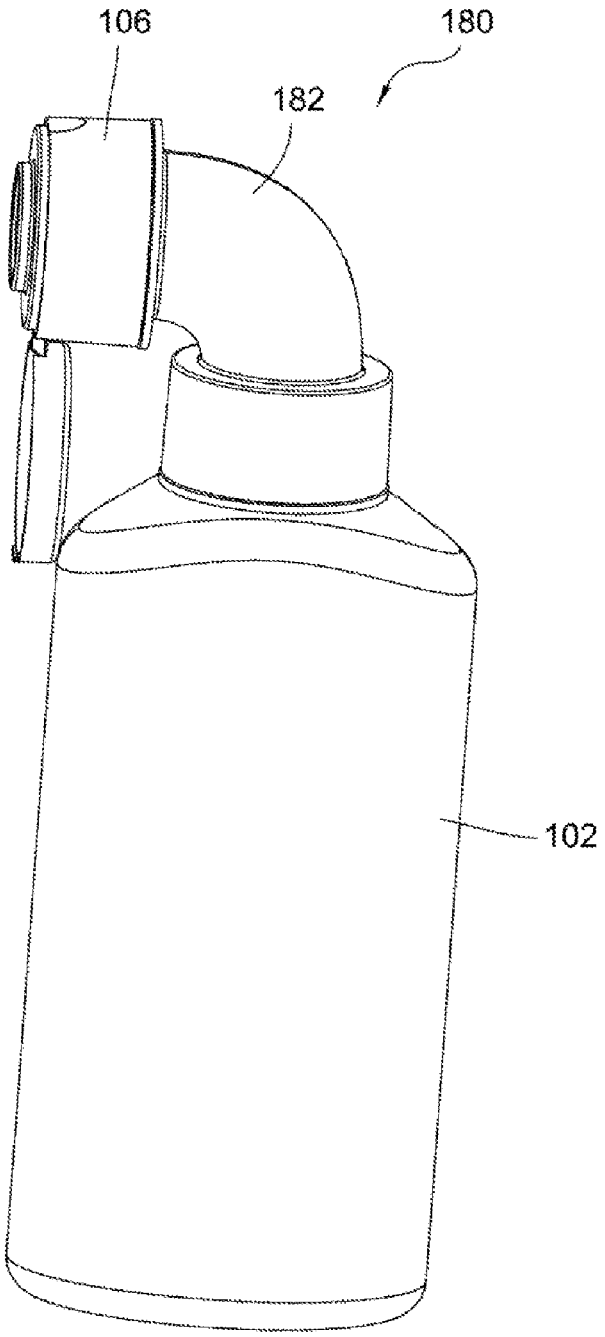
FIG. 21 is a perspective view of an upright squeeze sprayer according to a third exemplary embodiment of the present invention in accordance with various disclosed aspects.
Figure 22:
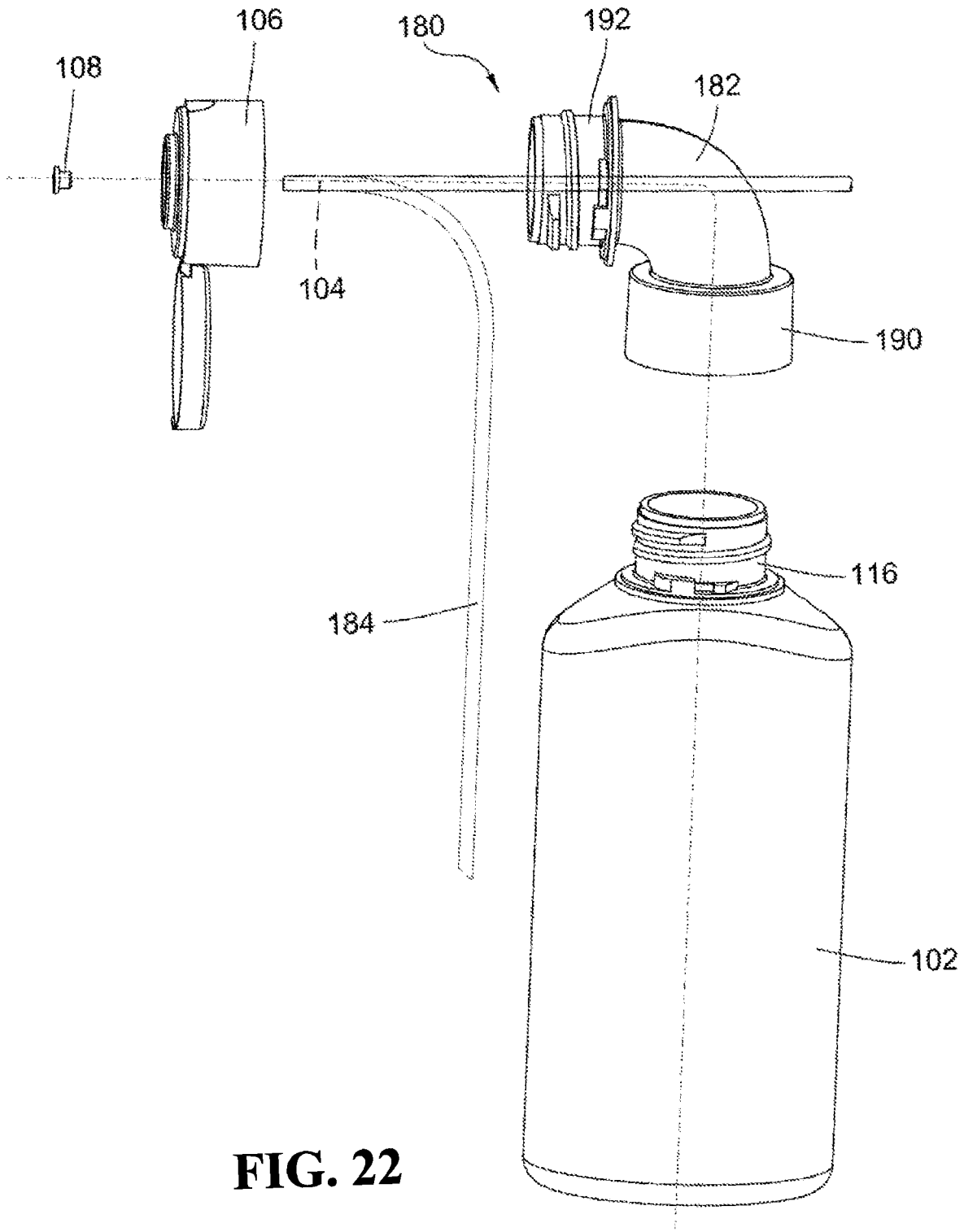
FIG. 22 is an exploded view of the FIG. 21 upright squeeze sprayer in accordance with various disclosed aspects.
Figure 23:
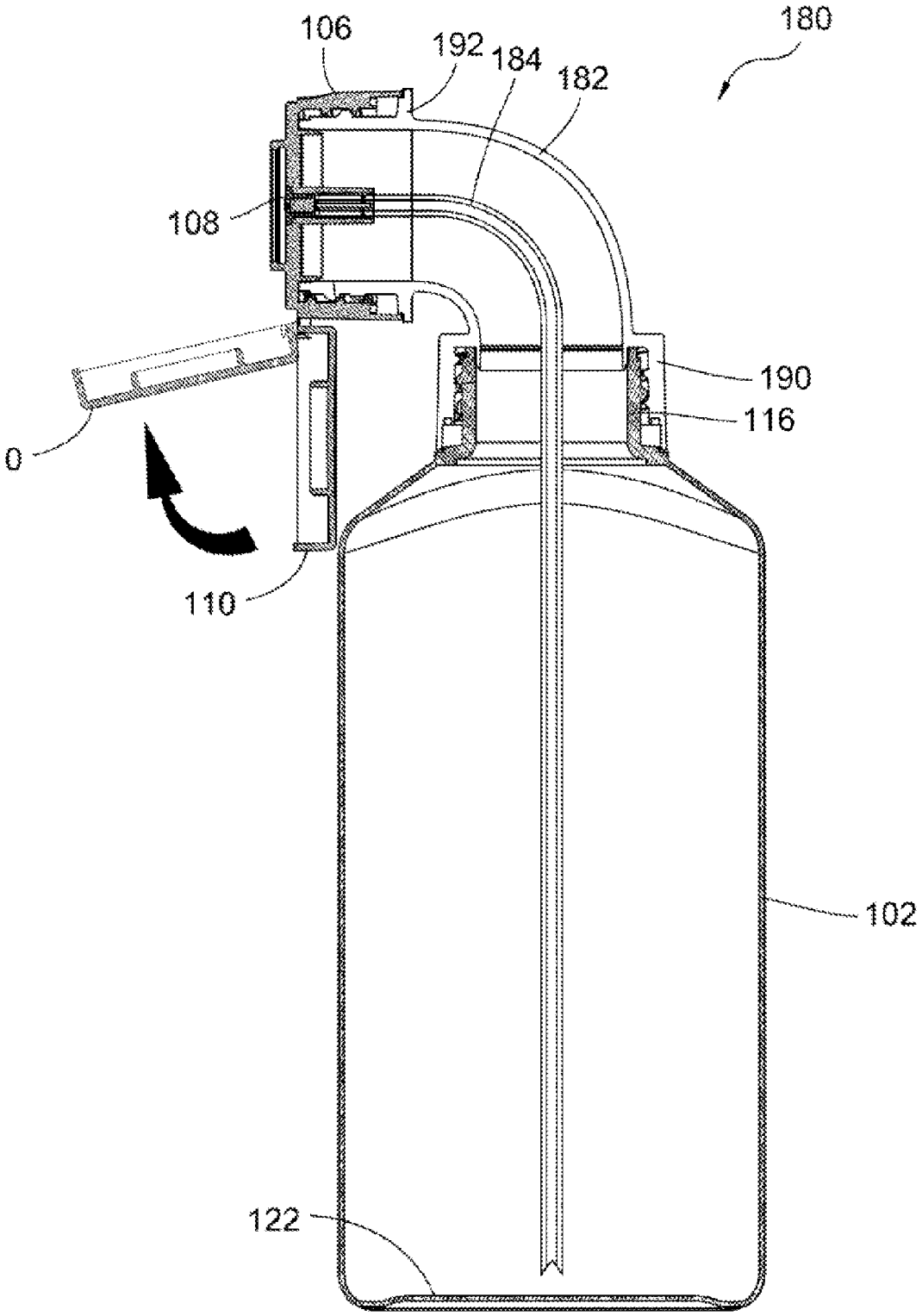
FIG. 23 is a front elevational view, in full section, of the FIG. 21 upright squeeze sprayer in accordance with various disclosed aspects.
Figure 24:
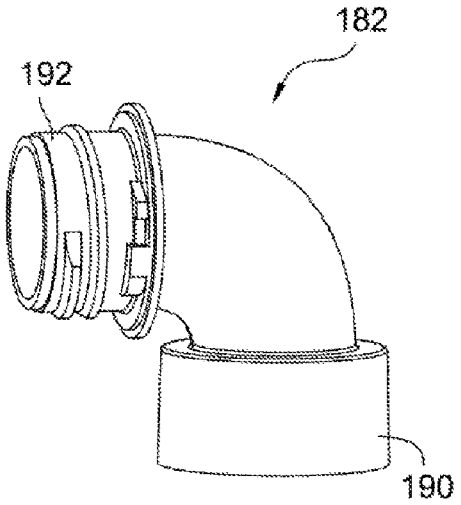
FIG. 24 is a perspective view of an adapter comprising one part of the FIG. 21 upright squeeze sprayer in accordance with various disclosed aspects.
Figure 25:
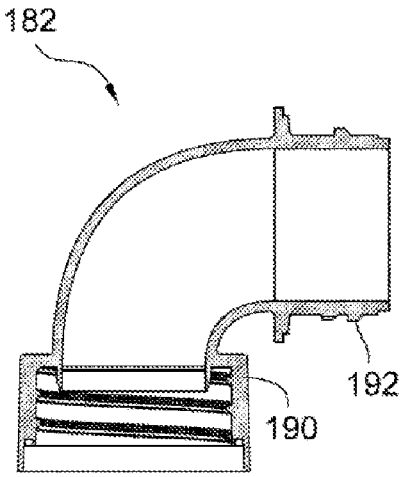
FIG. 25 is a side elevational view, in full section, of the FIG. 24 adapter in accordance with various disclosed aspects.
Figure 26:
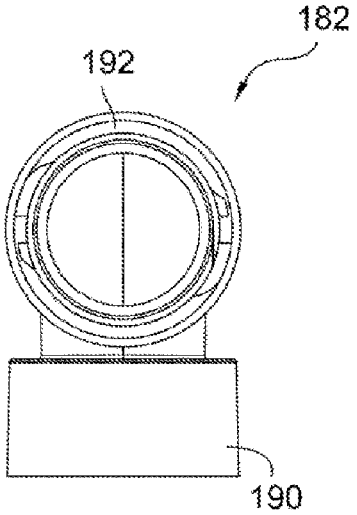
FIG. 26 is a front elevational view of the FIG. 24 adapter in accordance with various disclosed aspects.
Figure 27:
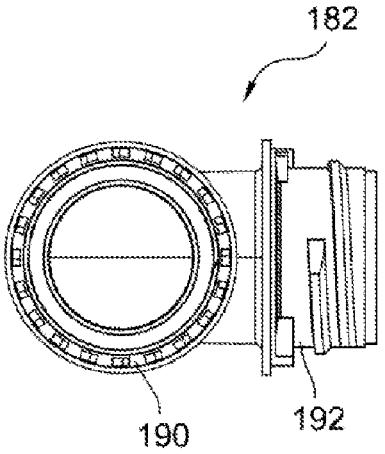
FIG. 27 is a bottom plan view of the FIG. 24 adapter in accordance with various disclosed aspects.

Referring now to FIGS. 21-76, there is illustrated an exemplary upright squeeze sprayer 180 with a directional adapter 182 which is positioned between container 102 and closure 106. The directional adapter 182 may allow a user to spray a product at different angles. It is further noted that, while directional adapter 182 is shown as coupled with the upright squeeze sprayer 180, the directional adapter 182 may be utilized with other embodiments, such as squeeze sprayer 20 which includes enclosure 22. Embodiments, however reference the upright squeeze sprayer at least for sake of brevity. It is further noted that like named components of upright squeeze sprayer 180 may include similar aspects as those described with reference to the various other embodiments.

The upright squeeze sprayer 180 may include orifice cup 108 coupled with a closure 106 and a directional adapter 182, which is positioned between the container 102 and the closure 106. The bend in adapter 182 may be generally j degrees, where j is a number (e.g., 90, 80, etc.). The bend operatively changes the spray direction from what would otherwise be generally axial with the container 102 (as shown in FIGS. 1-9 and 10-20) to a generally lateral or horizontal spray direction which is generally normal to the container 102. The direction of the spray is directly influenced by the bend formed in adapter 182.

As noted, the adapter 182 may be utilized with inverted or upright squeeze sprayers. In an aspect, the adapter 182 may be of a single construction with a closure (e.g., closure 22 or 106 and adapter 182 may be a single piece) or may be of a single construction with a container. In at least some embodiments, the closures 22 and 106 may be similar as to what has been described above, and dip tube 184 may be differently configured than dip tubes 30/104 to accommodate the bend in the adapter 182.

The construction and arrangement of container 102 and closure 106 upright squeeze sprayer 180 have not change from their prior form as used for upright squeeze sprayer 100. As shown in FIG. 29, the dip tube 184 is shaped to generally follow the bend of adapter 182. In this way the dip tube 184 maintains its inlet end 186 positioned near the bottom panel 122 of container 102 while the opposite end 188 of dip tube 184 is constructed and arranged to be coupled with the sleeve 118 of closure 106. It is noted, however, that in some embodiments a common dip tube may be utilized with or without the adaptor. For instance, an extendable or coiled dip tube may be utilized. The coiled or extendable dip tube may be flexible to allow for different lengths and applications while maintain an end or inlet of the dip tube near a bottom of a container. In an other example, a coupler may be utilized with the adapter 182 that couples the closure 106 to the dip tube 104.

An the illustrated example, adapter 182 includes a container end 190, a closure end 192 and a curved body 194 which extends between end 190 and end 192. Container end 190 is constructed and arranged to connect or attach onto neck 116 of container 102. The closure end 192 is constructed and arranged to connect or attach into closure 106. As noted herein, the container 102 and closure 106 may comprise the same aspects and configurations whether or not the adapter 182 is utilized. Accordingly, the closure end 192 is constructed and arranged to attach to the closure 106 in the same manner as described above with neck 116. Likewise, container end 190 is constructed and arranged to attach to the neck 116 in the same manner as described above with closure 106. It is further noted, that the container end 190 and the closure end 192 may lock with the neck 116 and closure 106 respectively.

As such, neither the container 106 nor the closure 102 need to be changed when the adapter 182 is used or not used. This may reduce the number and parts needed to construct different squeeze sprayers. This in turn allows the interchange of any number of similarly constructed adapters, but with different bend directions or degrees. The only changed is that the dip tube 104 may be shaped in a manner which is similar to how the directional adapter, such as adapter 182, is shaped. The use of adapter 182 allows the direction of the spray or spray mist, of the fluid product held in container 102, to be converted from vertical to horizontal, based on the orientations described and defined herein. In another aspect, the cavity within the body 182 of the adapter 182 may comprise the headspace for air. Thus the container 102 may comprise more initial fluid material when adapter 182 is utilized if desired.

In the course of working with the disclosed embodiments and various fluid products which have different viscosities, certain dimensions and dimensional ratios of components of the squeeze sprayers produce unexpectedly positive results, than others. For instance, different materials have different viscosities and changes in sizes, dimensions, or shapes to the channels 44, channels 136, sections of an orifice cup, or apertures allow for changing spray patterns based on the viscosities of the material. For materials having higher viscosity than water or similar liquids, such as a viscosity between 60 cps and 84 cps, (e.g., viscosities which would correspond to a cooking oil at standard ambient conditions such as 20 degrees C. degrees) the design and fabrication of squeeze sprayers can be modified to achieve a desired spray pattern. For the exemplary embodiments of the present invention, the following component part features are identified as those which would preferably have dimensional changes in order to address changes in fluid product viscosity. Table I (below) presents projected dimensional values for each such component part feature relative to various product viscosity ranges.

TABLE I

| Fluid Type | Avg. Viscosity @ 20° C. (cps) |
|---|---|
| Water | 1 |
| Corn Oil | 65 |
| Olive Oil | 84 |
| Maple Syrup | 2,500 |
| Liquid Soap | 8,000 |
| Honey | 10,000 |
| Ketchup | 50,000 |
| Peanut Butter | 200,000 |

As used herein, the words "example" and "exemplary" mean an instance, or illustration. The words "example" or "exemplary" or terms of similar import do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

What has been described above includes examples of the present specification. It is, of course, not possible to describe every conceivable combination of components or methodologies for purposes of describing the present specification, but one of ordinary skill in the art may recognize that many further combinations and permutations of the present specification are possible. Each of the components described above may be combined or added together in any permutation to define embodiments disclosed herein. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A squeeze sprayer for dispensing fluid product as a spray or spray mist, the squeeze sprayer comprising:
- a container;
- a cap coupled with the container, the cap comprising an outlet and a chamber for receipt of air and fluid product;
- a diaphragm valve coupled with the cap and comprising a fluid passageway to the chamber;
- a dip tube coupled to the cap, the dip tube comprising an inner fluid passageway in fluid communication with the chamber, wherein applying pressure to the container forces a first material through the fluid passageway of the valve and forces a second material through the inner fluid passageway of the dip tube; and
- wherein the valve includes side walls, a panel, and an opening formed through the panel.

2. The squeeze sprayer of claim 1 wherein the cap has a single-piece construction which includes a sleeve extending from a panel.

3. The squeeze sprayer of claim 2 wherein the sleeve defines the chamber.

4. The squeeze sprayer of claim 2 wherein the sleeve receives the dip tube.

5. The squeeze sprayer of claim 4, further comprising a fluid channel defined by a portion of an outer surface of the dip tube and a portion of the inner surface of the sleeve.

6. The squeeze sprayer of claim 5 wherein the chamber is in fluid flow communication with the fluid channel.

7. The squeeze sprayer of claim 2 wherein the cap includes a flip-top lid.

8. The squeeze sprayer of claim 1 wherein the cap and valve are coupled via a friction fit.

9. The squeeze sprayer of claim 1 wherein the panel has a different thickness than the side walls.

10. The squeeze sprayer of claim 1 wherein the first material is a fluid and the second material is a gas.

* * * * *